US006165324A

United States Patent [19]

Linden

[11] Patent Number: 6,165,324

[45] Date of Patent: Dec. 26, 2000

[54] MULTI-LAYER HEADBOX AND SEPARATOR VANE THEREFOR

[75] Inventor: Anders Linden, Karlstad, Sweden

[73] Assignee: Valmet Karlstad AB, Karlstad, Sweden

[21] Appl. No.: 09/256,005

[22] Filed: Feb. 23, 1999

Related U.S. Application Data

[60] Provisional application No. 60/081,329, Apr. 10, 1998.

[30] Foreign Application Priority Data

Mar. 2, 1998 [SE] Sweden ..... 9800642

[51] Int. Cl.[7] ..... D21F 1/02

[52] U.S. Cl. ..... 162/343; 162/344

[58] Field of Search ..... 162/343, 344, 162/336

[56] References Cited

U.S. PATENT DOCUMENTS

| | | | |
|---|---|---|---|
| 3,843,470 | 10/1974 | Betley et al. | 162/343 |
| 4,133,715 | 1/1979 | Hergert . | |
| 4,445,974 | 5/1984 | Stenberg | 162/343 |
| 4,812,209 | 3/1989 | Kinzler et al. | 162/343 |
| 5,545,294 | 8/1996 | Lindén et al. . | |

FOREIGN PATENT DOCUMENTS 196 52 983 5/1997 Germany .

*Primary Examiner*—Karen M. Hastings
*Attorney, Agent, or Firm*—Alston & Bird LLP

[57] ABSTRACT

A headbox for discharging a jet consisting of one or more stock layers to a forming zone in a former comprising at least one separator vane separating two stock channels in order to keep the stocks on each side of the separator vane separated from each other and having engagement dowels arranged in a row for detachable mounting on a turbulence channel group via an engagement part with a through-running groove to receive the upstream end portion of the separator vane and its engagement dowels to secure the separator vane in machine direction, said groove having two longitudinally extending recesses with support and guide walls facing the free engagement end portions of the engagement dowels. According to the invention the engagement dowels are yieldingly arranged in the separator vane to be displaced laterally in relation to an unaffected starting position when influenced by forces occurring at the support and guide walls, or to be inclined when the separator vane is pushed aside from its normal position to equalize a pressure difference between the two stock channels.

19 Claims, 4 Drawing Sheets

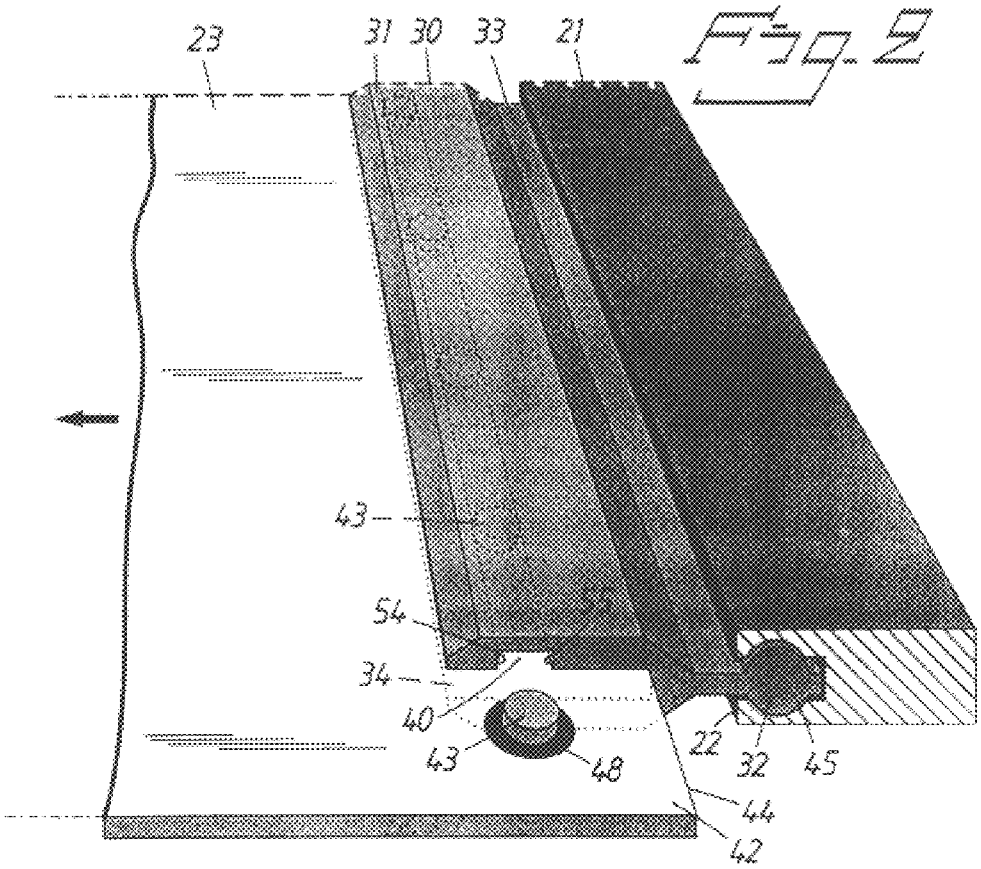
Fig. 2
Fig. 3
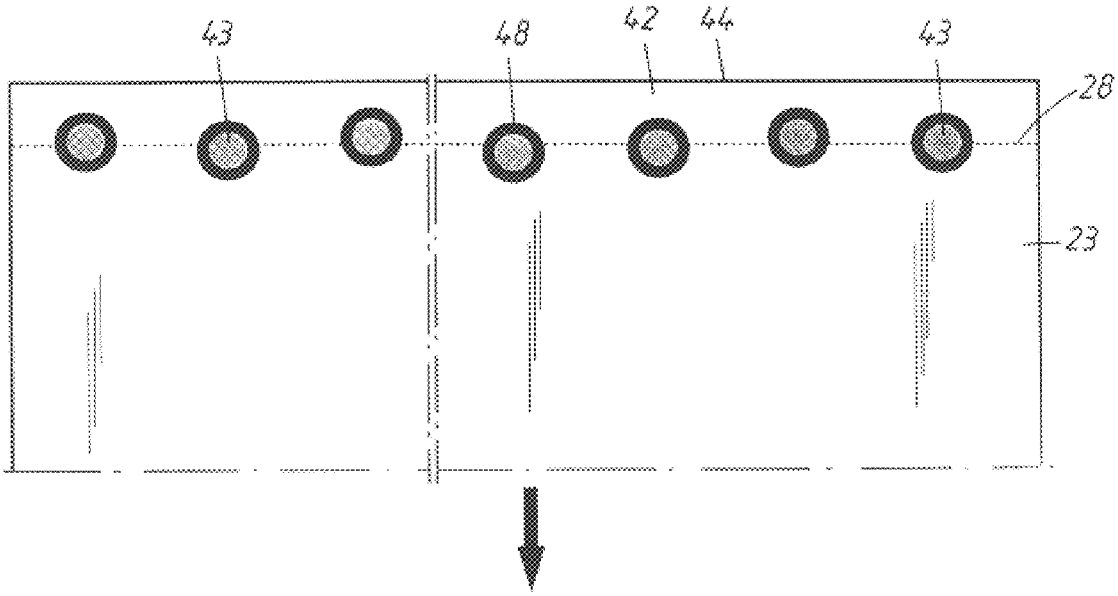

MULTI-LAYER HEADBOX AND SEPARATOR VANE THEREFOR

CROSS-REFERENCE TO RELATED APPLICATION

The present application claims the benefit of commonly owned U.S. Provisional Patent Application Ser. No. 60/081,329 filed Apr. 10, 1998.

FIELD OF THE INVENTION

The present invention relates to paper making machinery and, more particularly, to a headbox for discharging a jet consisting of at least two stock layers to a forming zone in a former for wet-forming a fibrous web.

BACKGROUND OF THE INVENTION

A known type of multi-layer headbox comprises a slice having a slice chamber and a slice opening, a turbulence generator defining a turbulence channel group for supplying stocks to the slice chamber, and at least one separator vane separating two stock channels in order to keep stocks on each side of the separator vane separated from each other when the stocks flow through the slice chamber. The separator vane is detachably mounted at its upstream end directly or indirectly on the turbulence channel group. The detachable mounting of the separator vane is effected by a plurality of short engagement dowels arranged in a row and spaced from each other, extending perpendicularly through the separator vane and protruding from at least one side of the separator vane. The protruding portion of an engagement dowel forms a free engagement end portion. An elongate construction element with a longitudinally extending groove open at both ends is provided for receipt of the upstream end portion of the separator vane and its engagement dowels to secure the separator vane in the machine direction. The groove has at least one longitudinally extending recess that forms support and guide walls facing the free engagement end portions of the engagement dowels.

When a separator vane of the type described above is being manufactured, its end portion, which is located upstream, is provided with a plurality of through-holes located a predetermined distance from the upstream edge of the separator vane. The holes are placed in a row as straight as possible, with equal spacing between them, within a predetermined tolerance interval in relation to a line parallel with the adjacent narrow edge of the separator vane. The aforementioned construction element is manufactured as straight as possible within a predetermined tolerance interval. The groove formed in the construction element is also made as straight as possible from end to end within a predetermined tolerance interval. In certain cases these tolerances at one and the same point along the upstream end portion of the separator vane, the opposing construction element and along the opposing groove, may be added together so that difficulties occur when the upstream end portion of the separator vane and its engagement dowels are inserted into the groove in the construction element from one open end to the other open end. In particular, one or more of the engagement dowels, as a result of the cumulative tolerances, can interfere with one of the support and guide walls inside the groove. One or more of the other engagement dowels may also press against the other support and guide wall in the groove as a result of the tolerances at these points being added together in the opposite direction within the prescribed tolerance interval. Errors caused by difficulties in maintaining prescribed tolerance intervals naturally also result in the above problems.

U.S. Pat. No. 5,545,294 shows a multi-layer headbox having rigid separator vanes, each of which has an upstream end clamped in bundle of tubes of the transverse distributor, and is provided with vane extensions thinner than the separator vanes. The vane extensions are detachably mounted on the separator vanes by means of short engagement dowels in the vane extensions and grooves in the separator vanes.

A jointed connection strip for a separator vane is shown in U.S. Pat. No. 4,133,715, but the separator vane is not provided with engagement dowels and the connection strip is thus not provided with a groove to fit engagement dowels. The object of the present invention is to provide a multi-layer headbox in which each separator vane is mounted in a grooved construction element in such a manner that the forces acting between the engagement dowels and the support and guide walls in the groove of the construction element are greatly reduced.

SUMMARY OF THE INVENTION

The headbox according to the invention is characterized in that the engagement dowels are yieldingly arranged in the separator vane such that they can be displaced laterally relative to the separator vane when influenced by forces occurring at the support and guide walls, and/or can be inclined or rotated relative to the separator vane such as may occur if the separator vane is pushed aside from its normal position to equalize a pressure difference between the two stock channels.

BRIEF DESCRIPTION OF THE DRAWINGS

The invention will be described in more detail in the following with reference to the drawings.

FIG. 2 is an enlarged scale view in perspective of an arrangement for mounting one of the separator vanes in the slice chamber of the headbox in connection with a group of pipes in the headbox according to FIG. 1.

FIG. 3 is a top view of a part of the separator vane according to FIG. 2.

DETAILED DESCRIPTION OF THE DRAWINGS

The present invention now will be described more fully hereinafter with reference to the accompanying drawings, in which preferred embodiments of the invention are 10 shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
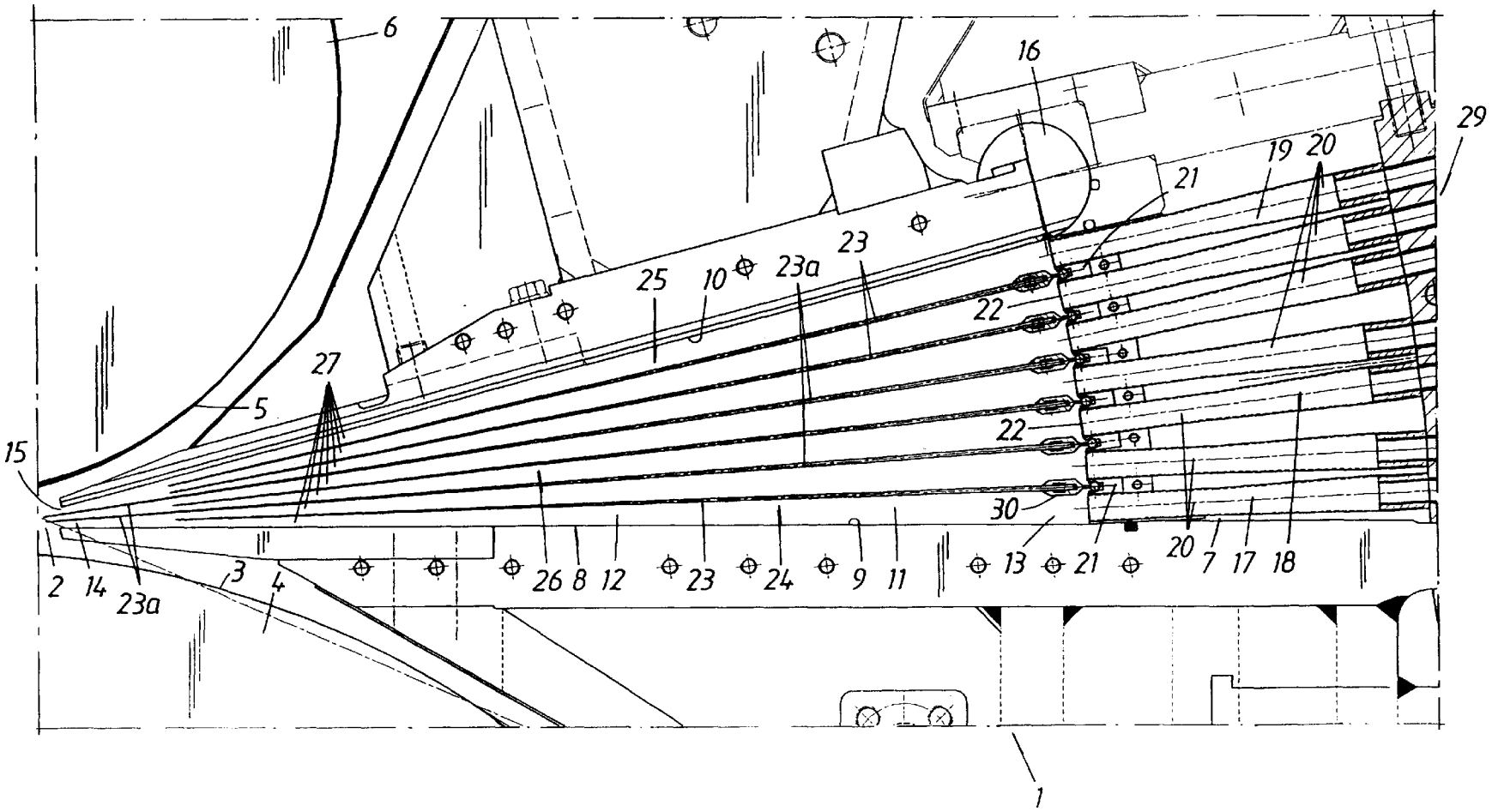
FIG. 1 is a longitudinal section in machine direction of a part of a multi-layer headbox mounted to discharge a multi-layer jet into a throat leading to the forming zone of a roll type twin wire former.
Figure 4:
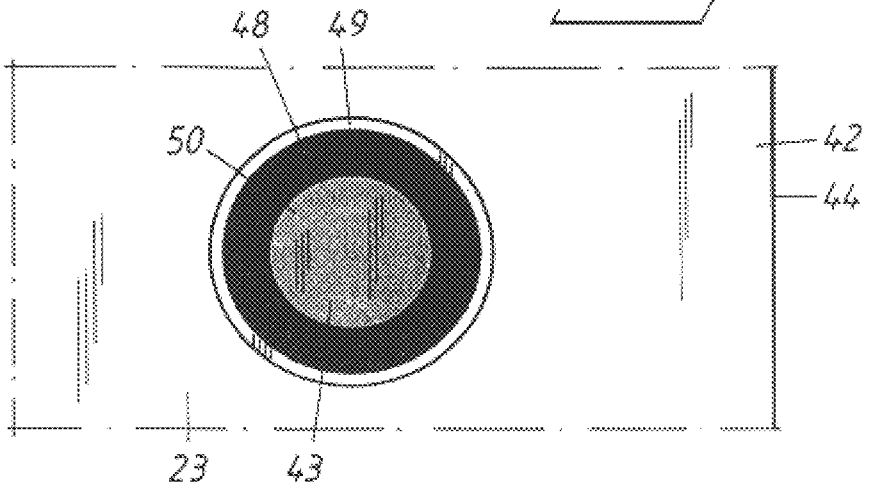
FIG. 4 is a top view of a part of the end portion of a separator vane situated upstream, showing one of the yielding engagement dowels according to the invention.
Figure 5:
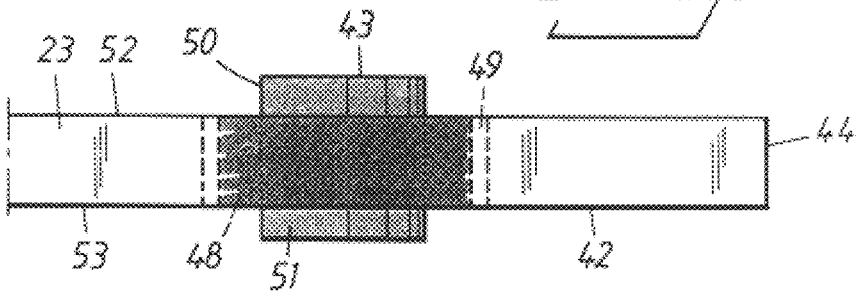
FIG. 5 is a side view of the end portion according to FIG. 4.

The headbox 1 shown in FIG. 1 is arranged to discharge a three-layer jet of stock into a throat 2 leading to a forming zone of a roll type twin wire former. Only certain parts of the twin wire former are shown. The twin wire former comprises an inner forming fabric 3 running in an endless loop, a rotatable forming roll 4 located within the loop of the inner forming fabric 3, an outer forming fabric 5 running in an endless loop, and a rotatable breast roll 6 located within the loop of the outer forming fabric 5.

The headbox has a turbulence generator 29 defining a turbulence channel group 7 which in the embodiment shown in FIG. 1 comprises a group of pipes. Instead of a group of pipes, also termed a pipe bundle or tube bank, a block with channels drilled through it may be used. The headbox shown also has a slice 8 located downstream thereof, comprising a bottom part 9, a top part 10 and two end pieces 11 extending between the bottom part 9 and top part 10. These four construction elements 9, 10, 11 enclose between them a slice chamber 12 which converges from its upstream end 13 in the direction of the stock stream, and terminates at its downstream end 14 in a slice opening 15 the width of which can be adjusted by turning the top part 10 about an axis 16 in relation to the bottom part 9 by means of a suitable actuator (not shown).

The pipe group comprises three pipe sections 17, 18, 19 arranged one on top of the other to supply three different stocks into the slice chamber 12. The lower pipe section 17 and the middle pipe section 18 each have two rows 20 of pipes arranged close together, while the upper pipe section 19 has three such rows 20 of pipes arranged close together. The rows 20 of pipes extend transversely to the machine direction. The pipe sections 17, 18, 19 are separated by assembly strips 21 extending across the machine direction and connecting the pipe sections 17, 18, 19 together. In the same way two adjacent pipe rows 20 are separated by similar assembly strips 21, also extending across the machine direction and joining the pipe rows 20 with each other. The outlet ends 22 of the pipes in the pipe rows 20 emerge directly into the slice chamber 12 and said assembly strips 21 are located at these outlet ends 22. At its upstream end the pipe group 7 is connected to a supply system (not shown) comprising three stock stores and suitable flow distributors to ensure uniform distribution of each stock to the rows of pipes 20 in the relevant pipe section 17, 18, 19 and a uniform distribution of stock within each pipe row 20.

In the embodiment shown the headbox comprising six separator vanes 23, of which two vanes 23*a* divide the slice chamber 12 into an outer, lower stock channel 24, an outer, upper stock channel 25 and an intermediate stock channel 26. The outer, lower stock channel 24 communicates with the lower pipe section 17, the intermediate stock channel 26 with the middle pipe section 18 and the outer, upper stock channel 25 with the upper pipe section 19. The two latter separator vanes 23*a* extend a distance past the slice opening 15. The other separator vanes 23 which have their downstream ends situated inside the slice chamber at a predetermined distance from the slice opening 15, divide the stock channels into two and three part stock channels 27, respectively, which are combined in respective stock channels 24, 25, 26 upstream of the slice opening 15. The separator vanes 23 are relatively rigid and consist preferably of glassfiber-reinforced epoxy resin. The separator vane is sufficiently stiff to be able to support various pressures and velocities in the stock streams.

Figure 6:
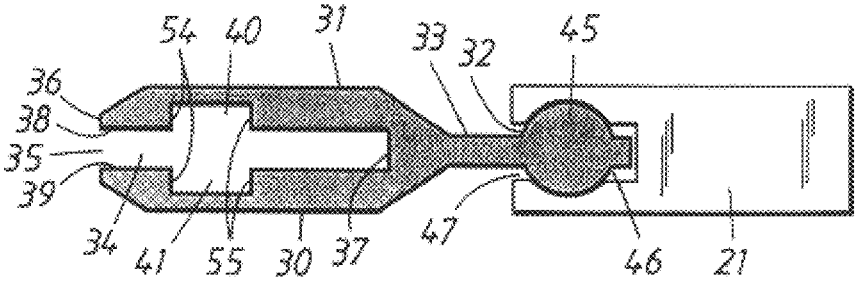
FIG. 6 is an end view of a connection strip and an assembly strip in the group of pipes in the arrangement according to FIG. 2.

The separator vanes 23 are directly or indirectly detachably mounted on said assembly strips 21 so that they are secured in the machine direction. In the embodiment illustrated in FIGS. 2 and 6 each separator vane 23 cooperates with a construction element in the form of a connection strip 30 with which the separator vane 23 is indirectly detachably mounted on the assembly strip 21. The connection strip 30 is as long as the width of the separator vane 23 and comprises a first engagement part 31 located downstream, a second engagement part 32 located upstream and a waist part 33 connecting these engagement parts. The first engagement part 31 is provided with a groove 34 extending through it from one end of the engagement part 31 to the other. The groove 34 has a longitudinally extending side opening 35 in the narrow side 36 located downstream and a bottom surface 37 located at a predetermined distance from said narrow side 36. The groove 34 is otherwise defined by two parallel walls 38, 39 extending between the side opening 35 and the bottom surface 37. Each wall 38, 39 is provided with a longitudinally extending recess 40, 41 forming opposing support and guide walls 54, 55. The recesses 40, 41 are situated opposite each other and at a predetermined distance from said narrow side 36. Seen in cross section, therefore, the groove 34 resembles a cross with the arms at right angles to each other and where two opposite arms are longer than the other two. The groove 34, the cross section of which is identical from one end of the engagement part 31 to the other, is shaped to receive the upstream end portion 42 of the separator vane 23 from one end of the engagement part 31, in order to detachably fit the separator vane 23 and the connection strip 30 together so that the separator vane 23 and connection strip 30 are secured to each other seen in the machine direction. For this purpose the upstream end part 42 of the separator vane 23 is provided with a plurality of relatively short engagement dowels 43 arranged in a row preferably equidistant from each other along a line 28 which is parallel with and located a predetermined distance from the narrow side 44 of the separator vane 23 situated upstream. The length of each engagement dowel 43 preferably is less than its diameter and it is provided with opposite, free engagement end portions 50, 51 protruding a predetermined distance from the opposing, flat sides 52, 53 of the separator vane 23. The length of the engagement dowel 43 is suited to the distance between the bottom surfaces of the recesses 40, 41 in the first engagement part 31 so that friction engagement obstructing movement is avoided therebetween during assembly and dismantling of the separator vane 23 and connection strip 30. For the same reason the distance between the row of engagement dowels 43 and the narrow side 44 of the separator vane 23 located upstream is suited to the distance between the recesses 40, 41 and the bottom surface 37 of the groove 34. The diameter of the engagement dowel 43 is somewhat less than the width of the recesses 40, 41 so that the engagement dowel 43 does not become caught between the support and guide walls 54 and 55. However, the difference may not be so great that excessive play occurs that might result in insufficient fixing of the separator vane 23. The diameter of the engagement dowel 43 is suitably 0.5–2 mm less than the width of the recesses 40, 41.

The second engagement part 32 is in the form of a longitudinally extending rod 45 which is received in a longitudinally extending groove 46 in the assembly strip 21, which groove 46 has a side opening 47 facing the slice chamber 12 which is smaller than the diameter of the round rod 45, but somewhat larger than the thickness of the waist part 33 so that the round rod 45 is retained in the groove 46 of the assembly strip 21 and so that the whole connection strip 30 and separator vane 23 can be hinged around the axis of the rod 45 like a hinge. The waist part 33 is also thin enough in relation to the two engagement parts 31, 32 of the waist part 33 itself, to be flexible. This ensures that the connection strip 30 is not broken at the waist part 33 when a separator vane 23 is pressed from its normal freely supported position due to a temporary decrease in pressure in one of the stock channels and/or pressure increase in the stock channel located on the other side of the separator vane 23.

Each engagement dowel 43, which suitably can be made of stainless steel, is mounted in yielding manner in the separator vane 23. For this purpose the engagement dowel 43 is supported by a resilient body 48 which surrounds the length of the engagement dowel 43 located in the separator vane 23. The resilient body 48 is permanently rigidly connected to the engagement dowel 43. The rigid connection can be achieved by vulcanization, gluing or press-fitting. The resilient body 48 consists of a suitable rubber or similar resilient material. It has a length corresponding to the thickness of the separator vane 23 so that its end surfaces are flush with the flat side surfaces 52, 53 of the separator vane 23. The separator vane 23 is provided with through-holes to receive the resilient body 48 and a support element 49 surrounding it, which is permanently rigidly connected to the resilient body 48 and which is attached to the separator vane 23 in the hole wall to form a permanent joint. In the embodiment shown the resilient body 48 is in the form of a bushing, i.e. a cylindrical sleeve, with relatively great wall thickness, and the support element 49 is a steel ring. The resilient bushing has a radial wall thickness, i.e. the difference between its outer and inner diameters, of 3–8 mm.

As shown schematically in FIG. 3, the holes for the engagement dowels 43 are placed along the line 28 in a row which should be as straight as possible within a tolerance interval, e.g. ±1 mm, in relation to the line 28. However, the resilient bodies 48 allow for some misalignment. Thus, in the embodiment shown, the central axes of the two outermost engagement dowels 43 are situated on the line while the others are situated on either one or the other side of the line 28 in an irregular manner. Thanks to the resilient bodies 48 surrounding the engagement dowels and being firmly anchored to the edges of the holes in the separator vane, an engagement dowel that does not coincide with the line 28 can be displaced laterally to an eccentric position in relation to its assembly hole in the separator vane when a lateral force is exerted on the engagement dowel 43 through either the left or the right support and engagement walls 54, 55, respectively, see FIG. 2. Depending on the position of the engagement dowel 43 in relation to the line 28, when the upstream end portion 42 of the separator vane is mounted on the connection strip 30 by the engagement dowels being pushed into the recesses 40, 41 with lateral force applied against one of the edges of the separator vane or connection strip (lying in the machine direction), the lateral force overcomes the total friction force exerted by the non-centered engagement dowels 43 on the walls 54, the recesses 40, 41.

If, for instance, a pump ceases to function for one of the channels 27, the pressure in this channel will drop to atmospheric pressure, but the pump for the adjacent channel continues to function and produce pressure. The separator vane separating the channels will then be pushed aside to equalize the pressure in the channels. If then there is a certain clearance in vertical direction at the upstream edge of the vane provided with engagement dowels—and a small clearance is probably required if the vane is to be able to fit into the groove 34 in the engagement part 32 of the connection strip 30—the vane will be positioned inclined in the groove 34. The engagement dowels 43 are then also forced to become inclined.

The invention is also applicable for a separator vane divided in two parts for detachable assembly of the two vane sections to each other, in which case the separator vane is suitably mounted on the turbulence channel group as described above.

Figure 7:
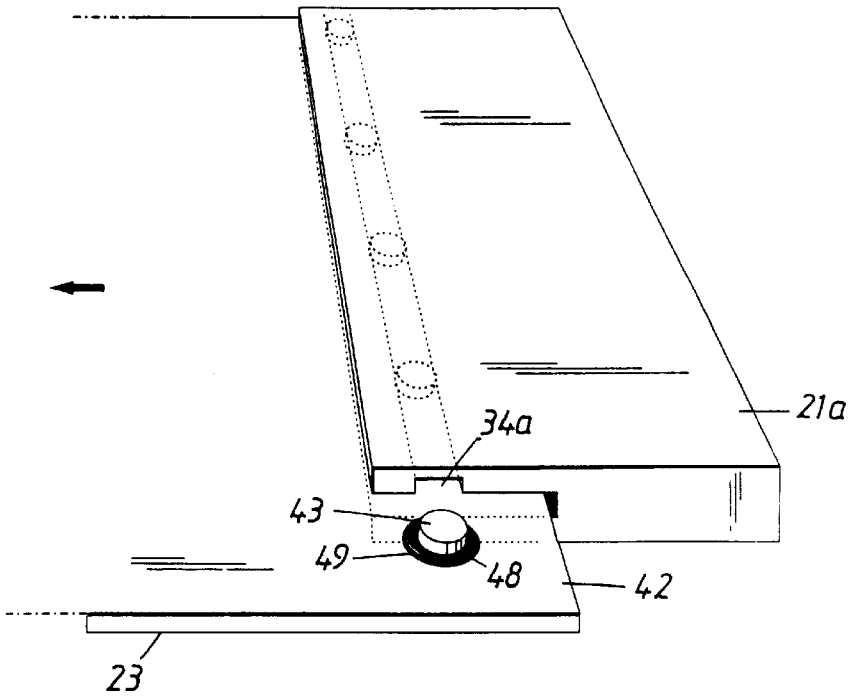
FIG. 7 is a perspective view of another arrangement for mounting a separator vane on, e.g. a group of pipes.

In another embodiment, shown in FIG. 7 the separator vane 23 is provided with a row of engagement dowels 43 at its upstream end portion 42 in the same way as described above, which engagement dowels 43 are journalled in resilient bodies 48 and support elements 49 as described above. The separate connection strip 30 is in this case eliminated and the assembly strip 21*a*, rigidly mounted on the turbulence channel group, is instead provided with a groove 34*a* of the same shape as the groove 34 in the first engagement part 31 of the connection strip 30 according to FIG. 6.

Figure 8:
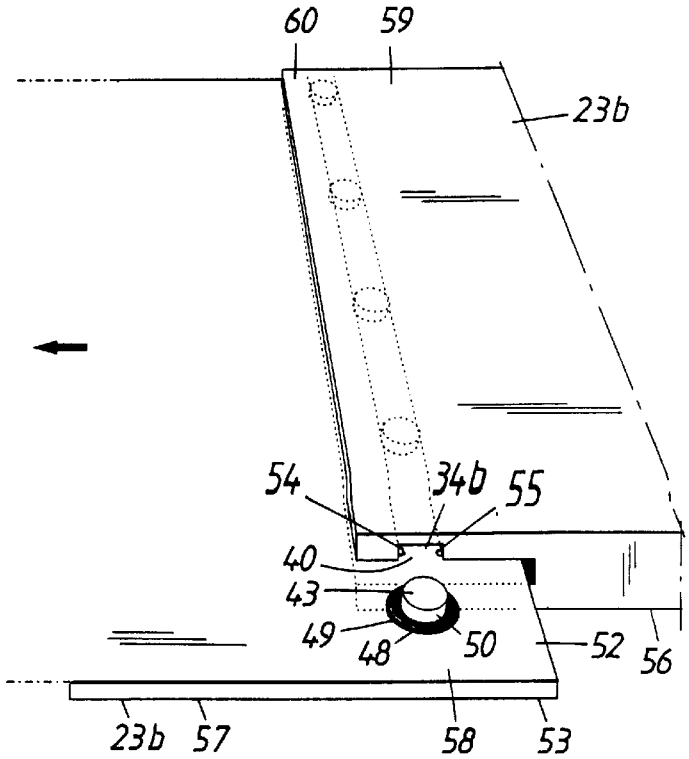
FIG. 8 is a perspective view of a two-part separator vane with a similar arrangement to that in FIG. 7 for mounting the two sections of the separator vane together.

In such an embodiment, illustrated in FIG. 8, the separator vane 23*b* is thus divided into an upstream vane section 56 and a downstream vane section 57. The downstream vane section 57 is provided with a row of engagement dowels 43 at its upstream end portion 58 in the same way as described above for the whole separator vane 23, which engagement dowels 43 are journalled, in resilient bodies 48 and support elements 49 as described above. The downstream end portion 59 of the upstream vane section 56 of the separator vane is in this case in the form of an engagement part 60 corresponding to the first engagement part 31 in the embodiment according to FIG. 6 as regards the shape and position of the groove 34*b*.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A headbox for discharging a multi-layer jet of papermaking stock having at least two stock layers to a forming zone in a former for wet-forming a fibrous web, comprising:

a slice defining a slice chamber therein and a slice opening for discharging stocks from the slice chamber;

at least one separator vane in the slice chamber so as to define two stock channels on opposite sides of the separator vane;

at least one elongate construction element disposed in the headbox and defining a groove extending longitudinally along the construction element for receipt of an upstream end portion of the separator vane, said groove defining at least one longitudinally extending recess forming opposing support and guide walls spaced apart in a flow direction of the slice chamber; and a plurality of engagement members mounted in the separator vane proximate the upstream end thereof, the engagement members being arranged in a row and spaced from each other, each engagement member protruding from at least one side of the separator vane to form a free engagement end portion, the free engagement end portions of the engagement members being received in the recess between the opposing support and guide walls, each of the engagement members being yieldingly connected to the separator vane so as to allow the engagement member to be displaced laterally or rotatably relative to the separator vane when influenced by forces occurring at said support and guide walls during operation of the headbox.

2. A headbox as claimed in claim 1, wherein the engagement members are yieldably displaceable relative to the separator vane in a direction parallel to the flow direction.

3. A headbox as claimed in claim 1, wherein each engagement member is rigidly mounted in a resilient body arranged in a hole in the separator vane and rigidly anchored thereto, the resilient body having end surfaces situated in the opposite side surfaces of the separator vane.

4. A headbox as claimed in claim 3, wherein the resilient body comprises a rubber bushing.

5. A headbox as claimed in claim 1, wherein the engagement member has engagement end portions protruding from each side of the separator vane, the groove in the construction element being provided with two recesses to receive the engagement end portions of the engagement members.

6. A headbox as claimed in claim 1, wherein said headbox further comprises a turbulence generator, and wherein said construction element comprises a connection strip having an upstream end hingedly connected to said turbulence generator, said groove being defined in a downstream end of the connection strip.

7. A headbox as claimed in claim 1, wherein said headbox further comprises a turbulence generator, and wherein said construction element comprises an assembly strip fixed to said turbulence generator.

8. A headbox as claimed in claim 1, wherein the separator vane comprises an upstream vane section and a downstream vane section arranged one after the other, said construction element being formed by a downstream end portion of the upstream vane section, said groove being defined in said downstream end portion, said groove extending transverse to the machine direction, and said engagement members being mounted in an upstream end portion of the downstream vane section.

9. A headbox for discharging a multi-layer jet of papermaking stock having at least two stock layers to a forming zone in a former for wet-forming a fibrous web, comprising:

a slice defining a slice chamber therein and a slice opening for discharging stocks from the slice chamber;

at least one separator vane disposed in the slice chamber so as to define two stock channels on opposite sides of the separator vane, the separator vane comprising an upstream vane section having an upstream end portion attached to structure of the headbox and a downstream end portion defining a groove extending transverse to a machine direction for receipt of an upstream end portion of the downstream vane section, said groove defining at least one transversely extending recess forming opposing support and guide walls spaced apart in a flow direction of the slice chamber; and a plurality of engagement members mounted on the downstream vane section proximate the upstream end portion thereof, the engagement members being arranged in a row and spaced from each other, each engagement member protruding from at least one side of the downstream vane section to form a free engagement end portion, the free engagement end portions of the engagement members being received in said at least one recess between the opposing support and guide walls, each of the engagement members being yieldingly connected to the downstream vane section so as to allow the engagement member to be displaced laterally or rotatably relative to the downstream vane section when influenced by forces occurring at said support and guide walls during operation of the headbox.

10. A headbox as claimed in claim 9, wherein the engagement members are yieldably displaceable relative to the downstream vane section in a direction parallel to the flow direction.

11. A headbox as claimed in claim 9, wherein each engagement member is rigidly mounted in a resilient body arranged in a hole in the downstream vane section and rigidly anchored thereto, the resilient body having end surfaces situated in the opposite side surfaces of the downstream vane section.

12. A headbox as claimed in claim 11, wherein the resilient body comprises a rubber bushing.

13. A headbox as claimed in claim 9, wherein the engagement member has engagement end portions protruding from each side of the downstream vane section, the groove being provided with two recesses to receive the engagement end portions of the engagement members.

14. A headbox as claimed in claim 9, wherein said headbox further comprises a turbulence generator, and wherein said upstream vane section is mounted on said turbulence generator by a transversely extending connection strip having an upstream end hingedly connected to said turbulence generator.

15. A headbox as claimed in claim 14, wherein said connection strip defines a transversely extending groove in a downstream end thereof for receipt of an upstream end of the upstream vane section.

16. A separator vane for a multi-layer headbox, comprising:

a generally planar vane member extending in a lengthwise direction from an upstream end to a downstream end thereof, the vane member being adapted to be mounted in a slice chamber of a multi-layer headbox for separating two stock flows; and a plurality of engagement members mounted to the vane member adjacent the upstream end thereof, the engagement members being arranged in a row and spaced from each other, each engagement member protruding from at least one side of the vane member to form a free engagement end portion, each of the engagement members being yieldingly connected to the vane member so as to allow the engagement member to be displaced laterally in a direction parallel to the lengthwise direction of the vane member and rotatably relative to the vane member.

17. The separator vane of claim 16, wherein the engagement members are mounted in holes formed through the vane member.

18. The separator vane of claim 17, wherein the engagement members are substantially rigid and are yieldingly mounted in said holes by resilient members.

19. The separator vane of claim 16, wherein said vane member comprises upstream and downstream vane sections detachably connected to each other, said engagement members being connected to said upstream vane section.

* * * * *